US007881647B2

(12) United States Patent
Anderson et al.

(10) Patent No.: US 7,881,647 B2
(45) Date of Patent: Feb. 1, 2011

(54) XEROGRAPHIC IMAGING MODULES, XEROGRAPHIC APPARATUSES, AND METHODS OF MAKING XEROGRAPHIC IMAGING MODULES

(75) Inventors: David G. Anderson, Ontario, NY (US); John F. Knapp, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 442 days.

(21) Appl. No.: 12/112,333

(22) Filed: Apr. 30, 2008

(65) Prior Publication Data

US 2009/0274490 A1 Nov. 5, 2009

(51) Int. Cl.
*G03G 15/08* (2006.01)

(52) U.S. Cl. ..... 399/281

(58) Field of Classification Search ..... 399/281
See application file for complete search history.

(56) References Cited

U.S. PATENT DOCUMENTS

| | | | | |
|---|---|---|---|---|
| 4,397,409 | A | 8/1983 | Fantuzzo et al. | |
| 4,399,933 | A | 8/1983 | Anderson et al. | |
| 4,518,245 | A * | 5/1985 | Bares | 399/272 |
| 4,990,958 | A | 2/1991 | Brewington et al. | |
| 5,047,806 | A | 9/1991 | Brewington et al. | |
| 5,212,522 | A | 5/1993 | Knapp | |
| 5,305,064 | A | 4/1994 | Trott et al. | |
| 6,026,265 | A * | 2/2000 | Kinoshita et al. | 399/281 |
| 6,149,564 | A * | 11/2000 | Nozawa et al. | 492/30 |
| 6,196,958 | B1 * | 3/2001 | Shiraki et al. | 492/59 |
| 6,473,587 | B2 | 10/2002 | van Woerkens | |
| 6,507,721 | B1 * | 1/2003 | Yergenson et al. | 399/281 |
| 6,571,077 | B2 * | 5/2003 | Thompson et al. | 399/267 |
| 6,952,550 | B2 * | 10/2005 | Ohkuwa et al. | 399/281 |
| 2006/0153589 | A1 * | 7/2006 | Sato et al. | 399/110 |

FOREIGN PATENT DOCUMENTS

JP 2002-236414 * 8/2002

OTHER PUBLICATIONS

Machine translation of JP-2002-236414.*

* cited by examiner

*Primary Examiner*—David M Gray
*Assistant Examiner*—G. M. Hyder
(74) *Attorney, Agent, or Firm*—Ronald E. Prass, Jr.; Prass LLP

(57) ABSTRACT

Xerographic imaging modules, xerographic apparatuses including the xerographic imaging modules and methods of making the xerographic imaging modules are disclosed. An embodiment of the xerographic imaging modules includes a photoreceptor roll having a photoconductive surface, a donor roll adjacent the photoreceptor roll for supplying toner to the photoconductive surface, and a toner loading roll adjacent the donor roll for supplying the toner to the donor roll. The toner loading roll includes a core comprised of a foam first material, and a non-porous surface region comprised of the first material. The surface region surrounds the core and forms an outer surface of the toner loading roll.

18 Claims, 3 Drawing Sheets

XEROGRAPHIC IMAGING MODULES, XEROGRAPHIC APPARATUSES, AND METHODS OF MAKING XEROGRAPHIC IMAGING MODULES

BACKGROUND

Xerographic imaging modules, xerographic apparatuses including the imaging modules and methods of making the imaging modules are disclosed.

Xerographic apparatuses can include a photoreceptor roll, which is charged and discharged to create latent electrostatic images on the roll. It would be desirable to be able to transport toner effectively to the photoreceptor roll to produce consistent images.

SUMMARY

Xerographic imaging modules, xerographic apparatuses, and methods of making xerographic imaging modules are disclosed. An embodiment of the xerographic imaging modules comprises a photoreceptor roll including a photoconductive surface; a donor roll adjacent the photoreceptor roll for supplying toner to the photoconductive surface; and a toner loading roll adjacent the donor roll for supplying the toner to the donor roll. The toner loading roll comprises a core comprised of a foam first material, and a non-porous surface region comprised of the first material. The surface region surrounds the core and forms an outer surface of the toner loading roll.

DETAILED DESCRIPTION

The disclosed embodiments include a xerographic imaging module, which comprises a photoreceptor roll including a photoconductive surface; a donor roll adjacent the photoreceptor roll for supplying toner to the photoconductive surface; and a toner loading roll adjacent the donor roll for supplying the toner to the donor roll. The toner loading roll comprises a core comprised of a foam first material, and a non-porous surface region comprised of the first material. The surface region surrounds the core and forms an outer surface of the toner loading roll.

The disclosed embodiments further include a xerographic imaging module, which comprises a photoreceptor roll including a photoconductive surface; a donor roll adjacent the photoreceptor roll for supplying toner to the photoconductive surface; and a toner loading roll adjacent the donor roll for supplying the toner to the donor roll. The toner loading roll comprises a core comprised of a foam first material, and a non-porous surface region comprised of a second material surrounding the core and forming an outer surface of the toner loading roll.

The disclosed embodiments further include methods of making xerographic imaging modules. An embodiment of the methods comprises making a toner loading roll by adding at least a first material into a first mold member; adding at least the first material into a second mold member; then joining the first mold member to the second mold member; and curing the at least a first material in the first mold member and the second mold member to produce the toner loading roll. The toner loading roll includes (i) a core comprised of a foam material; and (ii) a non-porous surface region surrounding the core, forming an outer surface of the toner loading roll, and comprised of the first material. The method further comprises mounting opposed ends of the toner loading roll, a donor roll and a photoreceptor roll to opposed walls of a housing, such that the donor roll is positioned between and adjacent the photoreceptor roll and the toner loading roll.

Figure 1:
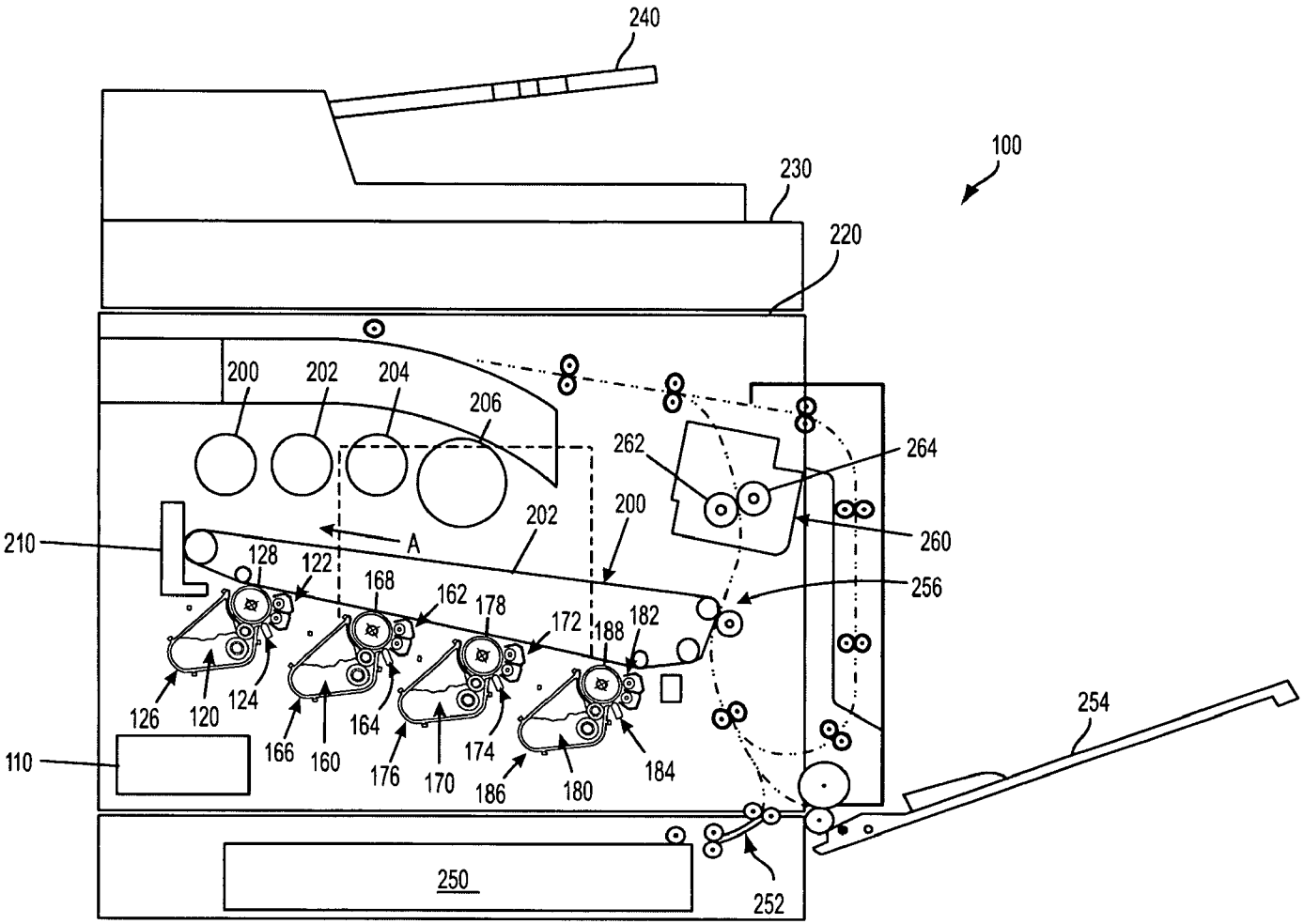
FIG. 1 illustrates an exemplary embodiment of a xerographic apparatus including multiple xerographic imaging modules arranged along an intermediate transfer belt.

FIG. 1 illustrates an exemplary embodiment of a xerographic apparatus 100. The xerographic apparatus 100 includes a controller and electronics unit 110 for controlling operation of components of the apparatus. Four, xerographic imaging modules 120, 160, 170 and 180 are successively arranged along a portion of the outer surface 202 of an intermediate transfer belt 200. The intermediate transfer belt 200 is a continuous belt comprised of an elastomeric material.

The xerographic imaging modules 120, 160, 170 and 180 include a charging station 122, 162, 172 and 182, respectively; an imaging station 124, 164, 174 and 184, respectively; and a developer station 126, 166, 176 and 186, respectively. The developer stations 126, 166, 176 and 186 include a photoreceptor roll 128, 168, 178 and 188, respectively.

In the embodiment, the xerographic imaging modules 120, 160, 170 and 180 each use a single-component developer material, i.e., only a toner. The xerographic imaging modules 120, 160, 170 and 180 each contain a supply of a different color of toner, such as black, magenta, cyan and yellow toner particles, respectively. The xerographic apparatus 100 also includes toner containers 200, 202, 204 and 206 associated with the xerographic imaging modules 120, 160, 170 and 180, respectively.

During operation of the apparatus 100, an original document having one or more colored images (e.g., multi-colored text images) on a surface can be placed on a transparent platen 220 by a user. The platen 220 is shown covered by a lid 230 in its closed position. Alternatively, multiple original documents can be placed on an upper feed tray 240 for making copies.

Figure 2:
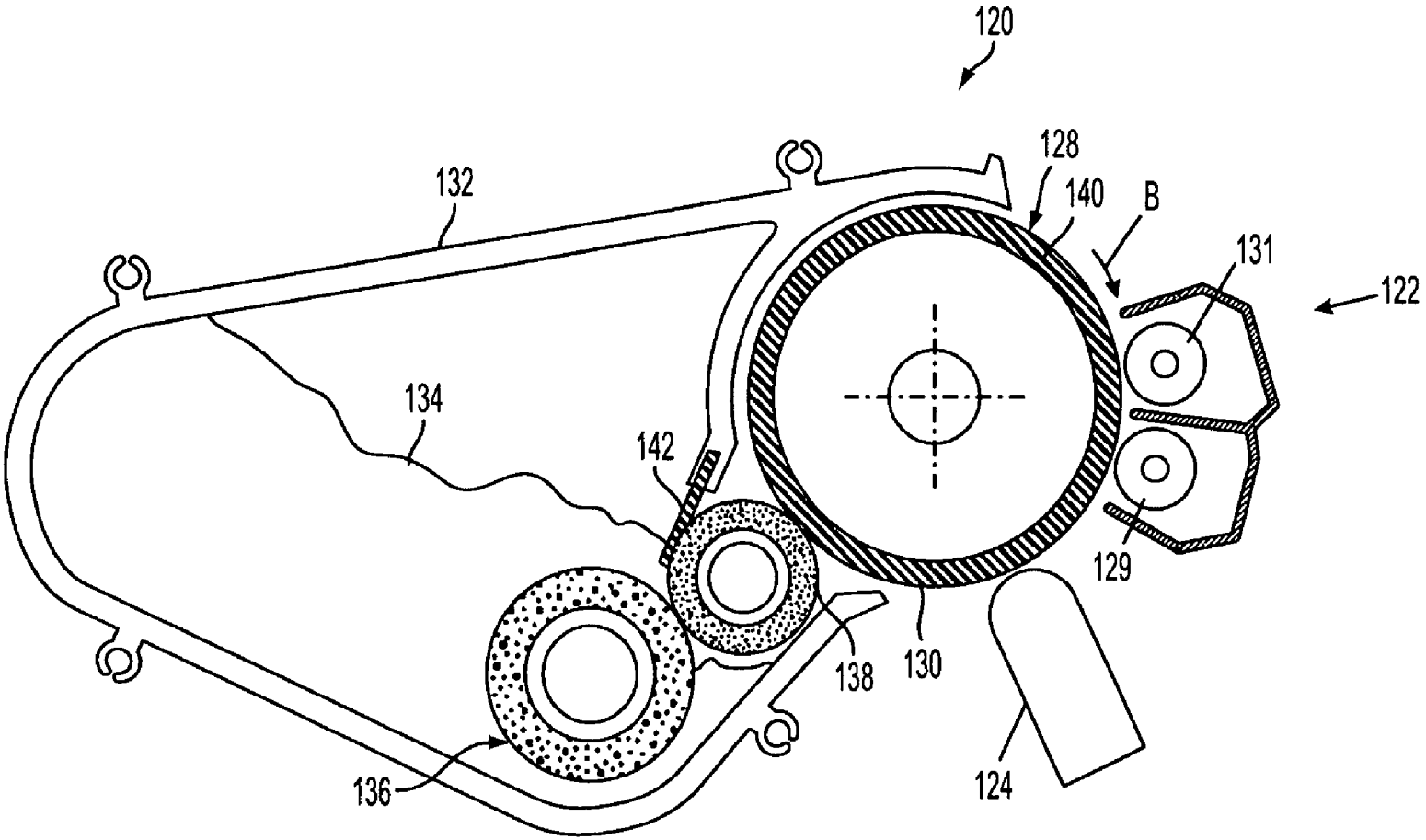
FIG. 2 illustrates one of the xerographic imaging modules shown in FIG. 1.

FIG. 2 is an enlarged view of the xerographic imaging module 120 of the xerographic apparatus 100. The xerographic imaging modules 160, 170 and 180 have the same construction and operate in the same way as the xerographic imaging module 120. For simplicity, only the construction and operation of the xerographic imaging module 120 will be described in detail.

As shown in FIG. 2, the photoreceptor roll 128 rotates clockwise, as indicated by arrow B. The charging station 122 produces an electrical charge on the outer surface 130 of the photoreceptor roll 128. The charging station 122 includes a biased charge roll 129 and a cleaner 131. The biased charge roll 129 is a conductive roll comprised of an elastomeric material. The photoreceptor roll 128 is first charged to a uniform charge using the biased charge roll 129. In the illustrated embodiment, the biased charge roll 128 is positioned adjacent, and in close proximity to, the outer surface 130 of the photoreceptor roll 128, for non-contact charging of the photoreceptor roll 128. In other embodiments, the biased charge roll 129 can be positioned in contact with the outer surface 130 of the photoreceptor roll 128.

The charged photoreceptor roll 128 is exposed with light at the imaging station 124. The imaging station 124 includes a suitable light source, such as a laser-based raster output scanner (ROS), or a light-emitting diode (LED) bar, to expose the photoreceptor roll 128. The portions of the outer surface 130 of the photoreceptor roll 128 that are hit with light emitted by the light source are discharged to form a latent electrostatic image on the photoreceptor roll 128. This latent electrostatic image on the photoreceptor roll 128 is then developed with toner to form a toner image on the photoreceptor roll 128 as the image passes through the developer station 126.

The intermediate transfer belt 200 rotates counter-clockwise, as indicated by arrow A in FIG. 1. The toner image is transferred from the photoreceptor roll 128 to the intermediate transfer belt 200 as the toner image is moved through an interface between the photoreceptor roll 128 and the intermediate transfer belt 200. Similarly, a toner image is also transferred, in successive order, from each of the photoreceptor rolls 168, 178 and 188 of the respective xerographic imaging modules 160, 170 and 180 positioned downstream from the xerographic imaging module 120 along the direction of movement of the intermediate transfer belt 200. The xerographic imaging modules 120, 160, 170 and 180 form a first transfer zone in the xerographic apparatus 100. The four toner image transfers to the intermediate transfer belt 200 are for the four respective toner colors. These transfers to the intermediate transfer belt 200 are accomplished by a combination of electrostatic effects and physical contact. As a result of the transfers, four color separations (black, magenta, cyan and yellow) are built up in a full-color toner image on the intermediate transfer belt 200.

The xerographic apparatus 100 further includes a tray 250 containing copy sheets, e.g., paper sheets. A paper feeding and registration system 252 is disposed adjacent the tray 250 for feeding individual copy sheets from the tray 250. A lower feed tray 254 can be used to alternatively feed envelopes or letterhead, for example.

The full-color toner image is transferred from the intermediate transfer belt 200 to a paper sheet at a second transfer zone 256 of the xerographic apparatus 100. The second transfer zone 256 is located where the paper moving from the tray 250 via the paper feeding and registration system 252 intersects the intermediate transfer belt 200. At the second transfer zone 256, the toner is electrostatically and physically transferred from the intermediate transfer belt 200 to the paper.

The xerographic apparatus includes a belt cleaner 210 to clean the intermediate transfer belt 200 after the toner image is transferred to the copy sheet, before the intermediate transfer belt 200 rotates around to receive the next image at the xerographic module 120.

After the copy sheet exits the second transfer station 256, the full-color toner image is loosely bound on the surface of the copy sheet. The copy sheet with the full-color image is passed to a fuser station 260. The fuser station 260 includes a heated fuser roll 262 and a pressure roll 264. Other embodiments of the fuser station 260 can include a heated fuser belt (not shown) for contacting the copy sheet. The fuser roll 262 and pressure roll 264 apply heat and pressure to melt and affix the toner to the surface of the copy sheet. The fusing station 260 also establishes a gloss level of the final image. The copy sheet with the fused toner image is then transferred to an output tray of the xerographic apparatus.

As shown in FIG. 2, the xerographic imaging module 120 comprises a housing 132 configured to contain a supply of toner 134 in a sump region inside of the housing 132. A toner loading roll 136 is immersed in the toner 134 inside of the housing 132. The toner loading roll 136 is rotatable to supply the toner 134 to a donor roll 138 disposed adjacent the toner loading roll 136. The toner loading roll 136 and donor roll 138 are typically driven by motors (not shown). The donor roll 138 is rotatable to deliver the toner 134 to the photoreceptor roll 128 disposed adjacent the donor roll 138. The photoreceptor roll 128 has a photoconductive layer 140 forming the photoconductive outer surface 130. The photoreceptor roll 128 is typically driven by a motor (not shown).

A doctor blade 142 is provided inside of the housing 132 to meter the supply of the toner 134 onto the donor roll 138. The doctor blade 142 can also charge the toner 134 by friction and triboelectrification effects, i.e., electron transfer resulting from contact and separation between the doctor blade 142, donor roll 138 and toner surfaces, or by electrically biasing the doctor blade 142.

The photoreceptor roll 128 is charged and selectively discharged to produce a latent electrostatic image on the photoconductive layer 140 of the photoreceptor roll 128. Most of the toner 134 is transferred from the donor roll 138 to the image areas of the photoreceptor roll 128. Toner 134 that is supplied to the non-image areas of the photoreceptor roll 128, and a small amount of residual toner at the image areas of the photoreceptor roll 128, is returned by rotation of the donor roll 138, disturbed by the toner loading roll 136, and then mixed with fresh toner 134 transported by the toner loading roll 136 from the sump.

Figure 3:
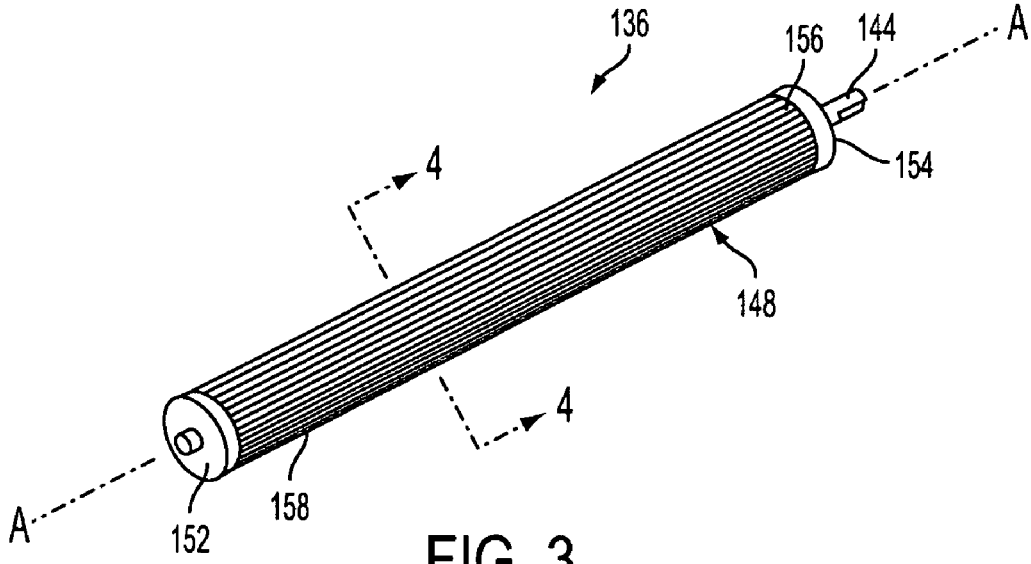
FIG. 3 illustrates an exemplary embodiment of the toner loading roll of the xerographic imaging module of FIG. 2.
Figure 4:
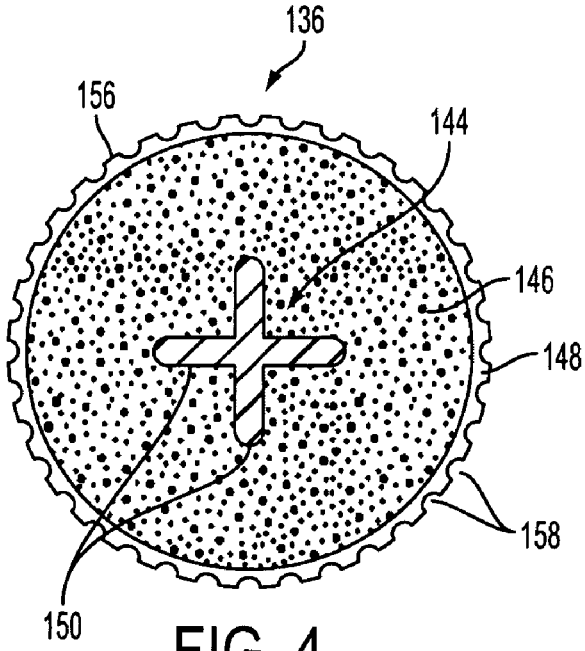
FIG. 4 is a cross-sectional view taken in the direction of line 4-4 of FIG. 3.

FIGS. 3 and 4 depict an embodiment of the toner loading roll 136. As shown, the toner loading roll 136 comprises a shaft 144, a core 146 formed on the shaft 144, and a surface region 148 surrounding the core 146. As shown, the shaft 144 includes vanes 150 spaced around the circumference of the shaft 144 to provide structural integrity to the material of the core 146. The core 146 is securely fixed to the shaft 144. In an embodiment, the core 146 is bonded to the shaft 144 during the process of forming the core.

During manufacturing of the xerographic imaging module 120, for example, the opposite ends 152, 154 of the toner loading roll 136 are mounted to opposite walls (not shown) of the housing 132. The walls are typically approximately perpendicular to the longitudinal axis of the toner loading roll 136. Typically, bearings and bearing seals are installed in a pair of endplates. The shafts on one end of the toner loading roll 136, donor roll 138 and photoreceptor roll 128 are inserted through the bearings operatively connected to one endplate. The opposing endplate is assembled to the housing 132, and the other end of the toner loading roll 136, donor roll 138 and photoreceptor roll 128 is inserted through the bearings in the opposing endplate.

The core 146 is comprised of a solid foam material. The foam material is porous and can be open-cell foam or closed-cell foam. The surface region 148 surrounds the core 146 and includes the outer surface 156 of the toner loading roll 136. The toner 134 is comprised of small particles, which can typically have a diameter of less than about 10 microns. The surface region 148 is constructed to prevent the penetration of the outer surface 156 by toner particles during operation of the xerographic imaging module 120. The core 146 is protected by the surface region 148 so that finely-divided toner does not impregnate and impact the foam material of the core 146. In an embodiment, the surface region 148 and the core 146 are both comprised of an elastic material. By constructing the toner loading roll 136 with the toner penetration-resistant surface region 148, the elasticity of both the surface region 148 and the core 146 can be maintained for a longer period of use as compared to forming the surface region 148 and core 146 of materials that can be penetrated by toner. Consequently, the desired rate of toner transport from the toner loading roll 136 to the donor roll 138 can be maintained over a longer service life in the xerographic imaging module 120.

In some embodiments of the toner loading roll 136, the core 146 and the surface region 148 are both comprised of the same material. In other embodiments of the toner loading roll 136, the core 146 and the surface region 148 are comprised of different materials, which can provide different mechanical, chemical and/or electrical properties in the core 146 and surface region 148.

The outer surface 156 of the toner loading roll 136 is non-porous. That is, the outer surface 156 is free of pores, in the form of holes, openings, or other defects. The outer surface 156 is a smooth, continuous toner-impermeable surface overlying the core 146. Because the outer surface 156 is non-porous, toner particles do not have open pathways to penetrate into the material of the surface region 148, or into the core 146 below the outer surface 156.

In embodiments, the outer surface 156 of the toner loading roll 136 has a sufficiently-high hardness to prevent penetration of the non-porous outer surface by toner. Consequently, toner particles are unable to become embedded in the outer surface 156 during operation of the xerographic imaging module 120. The outer surface 156 can typically have a Shore-A hardness of about 10 to about 45 to prevent such toner penetration.

The surface region 148 of the toner loading roll 136 can have a thickness of about 0.05 mm to about 0.5 mm. Increasing the thickness of the surface region 148 can increase the lifetime of the toner loading roll 136. The toner loading roll 136 is generally cylindrical shaped. The dimensions of the toner loading roll 136 can be varied depending on the size of the xerographic imaging module 120. The toner loading roll 136 can typically have a length of about 250 mm to about 400 mm, and a diameter of about 20 mm to about 50 mm, for example.

The core 146 and surface region 148 of the toner loading roll 136 can comprise any suitable material(s) that provide(s) the desired properties for use in the xerographic imaging module 120. These properties can include selected physical, chemical and electrical properties. The material forming the surface region 148 is desirably tear resistant. For example, this material can have a tear resistance of at least about 100 lbf/in as measured by ASTM standard D-3574. The material forming the surface region 148 also resists wear caused by contact with the toner 134 in the operating environment of the xerographic imaging module 120. The core 146 and surface region 148 are desirably comprised of a material having a suitably low compression set. For example, the compression set can be less than about 10% at a temperature of 130° F. over 24 hours at a total compression of about 25%, as measured by ASTM standard D-3574. The material of the surface region 148 is also chemically compatible with the toner 134.

The composition of the surface region 148, and optionally of the core 146, can be selected to provide desired electrical properties in the xerographic imaging module 120. These electrical properties can be controlled by incorporating an effective amount of electrically conductive material, e.g., carbon or the like, into the material used to form the surface region 148 during manufacture of the toner loading roll 136. The electrical properties of the surface region 148 can be chosen to provide desired triboelectrical charging interaction with the toner and/or the donor roll 138.

In embodiments, a portion of, or the entire, outer surface 156 of the toner loading roll 136 can include surface features effective to enhance loading of toner from the toner loading roll 136 onto the donor roll 138. The surface features can be surface depressions and/or raised surface regions (i.e., protuberances). The outer surface 156 of the toner loading roll 136 including these features is a continuous, toner-impermeable outer surface (or "skin") effective to prevent finely-divided toner from entering the underlying core 146 and compacting the core material.

As shown in FIGS. 3 and 4, the outer surface 156 of the toner loading roll 136 can comprise U-shaped, longitudinal grooves 158, which can extend parallel to the longitudinal axis A-A of the toner loading roll 136. The longitudinal grooves 158 can be uniformly spaced around the circumference of the toner loading roll 136. U-shaped grooves are desirable because all sides are gently covered or rounded with no sharp corners where small toner particles can be trapped. In embodiments, the longitudinal grooves can have other suitable cross-sectional shapes, such as V-shaped, rectangular-shaped, or the like.

Depressions, e.g., dimples or the like, formed in the outer surface 156 of the toner loading roll 136 can have the shape of small pockets or holes. The outer surface 156 typically includes multiple depressions having a selected size, shape and volume. The depressions can be uniformly dispersed on a portion of, or on the entire, outer surface 156. The volume of the depressions can be determined for any given development configuration or development requirements.

The toner loading roll 136 can be made by any suitable manufacturing process. In embodiments, the toner loading roll 136 is molded. A typical molding process uses two semi-cylindrical shaped mold members, where each mold member produces one-half of the toner loading roll 136. In embodiments, the inner surface of each mold member is contoured to produce the desired surface contour in the outer surface 156 of the toner loading roll 136. For example, the inner surface of each mold member can include protuberances to produce corresponding depressions (e.g., dimples or voids) in the outer surface 156 of the toner loading roll 136. In other embodiments, the inner surface of each mold member can include depressions to produce corresponding raised features on the outer surface 156 of the toner loading roll 136.

In embodiments of the molding process used to form the toner loading roll, the inner surface of each mold member is coated with a mold release agent, such as a wax, fluorocarbon, or the like, to enhance removal of the toner loading roll 136 from the mold members after the molding process is completed.

In embodiments of the toner loading roll 136 in which the core 146 and surface region 148 are comprised of the same material, a sufficient amount of this material is added to each mold member, typically after applying the mold release agent. The mold members are then joined together, and the material that has been added to the mold members is allowed to solidify to produce both the core and the surface region surrounding the core. In these embodiments, the foam material is self-skinning, with the surface region being integrally formed with the core and forming a continuous, toner-impermeable outer surface of the toner loading roll.

In the embodiments, the toner loading roll can be comprised of any suitable elastomeric material. Exemplary materials that can be foamed to produce the core and the surface region of the toner loading roll include polyurethanes, polyvinylchloride, silicones, polystyrenes, styrene acrylonitrile, cellulose acetate, phenolics, and the like. The foamed material is elastic so that it can be deformed and then rapidly recover its original shape once the deforming force has been removed.

In an exemplary embodiment, both halves of a two-piece mold are coated with a mold release material. Then, both halves of the mold are coated with polyurethane. When using polyurethane materials, pre-measured amounts of a polyol and an isocyanate can be pre-mixed. The pre-mixed materials are poured into both halves of the mold, the mold is closed, and the foam is allowed to form in-situ. Typically, for polyurethane elastomeric coating films and foam materials, process conditions including a cure time of about 10 minutes to about 20 minutes, a cure temperature of about 40° C. to about 45° C., and atmospheric pressure, can be used to form the toner loading roll.

In embodiments, the thickness and uniformity of the surface region surrounding the core can be controlled by controlling the temperature difference between the inner surface of the mold and the material that is added to the mold to form the core and surface region. Increasing this temperature differential decreases the thickness of the surface region formed over, and integrally bonded to, the core.

The foam can be formed on a shaft of any suitable material. Typical resin base materials that can be used to make the shaft include, e.g., polypropylenes, polyethylenes, chlorinated polyethers, acrylonitrile butadiene styrene, polystyrene, acetates, fluorocarbons, methylmethacrylate and the like. One suitable material for the shaft is acrylonitrile butadiene styrene with 20% glass filled fibers.

In another embodiment of the toner loading roll, the surface region and the core of the toner loading roll are formed by a molding process, which includes adding a first material to each mold member, followed by adding a second material to each mold member over the first material. In some embodiments, the first material and second material are the same material. In other embodiments, the first material and second material are different materials. A separate elastomeric layer, which forms the surface region, is bonded to the foam core of the toner loading roll. The same materials that can be used to produce embodiments of the toner loading roll including an integral core and surface region (i.e., embodiments in which the foam material is self-skinning and produces the surface region) can be used in the embodiments that use the same first material and second material (as well as in other embodiments that use different first and second materials).

In embodiments that form a separate outer surface and core during the molding process, the inner surface of each mold member is typically coated with a mold release agent. Then, a sufficient amount of a material used to form the surface region having a desired thickness upon solidification is added to each mold member. Any suitable material can be used to form the surface region of the toner loading roll. The material can be selected from the group of elastomeric materials that can form non-porous surface coatings on foam materials. For example, urethane materials can be used to form films that have long-wearing properties in the toner loading roll, and can be used to form the surface region. The surface region is made of a material that is impenetrable by finely divided toner particles to provide increased operational life of the xerographic imaging module. The surface region is free of pores and provides a smooth, uniform, continuous toner-impermeable coating to the toner loading roll. The material of the surface region is also chemically compatible with the toner and toner additives.

In embodiments, after coating both mold members with the material used to form the surface region, the material used to form the core is added to the mold members to form a good adhesive bond between the surface region and the core material. The core is made from a foam material. Using polyurethane materials, for example, pre-measured, pre-mixed foam component materials can be poured into the mold members. The mold members are then closed and the foam is allowed to form in-situ. In the molding process, it is desirable that each successive step be performed as soon as possible after the preceding step has been completed in order to form a strong bond between the foam material and the material of the surface region. This bond can enhance the reliability of the toner loading roll over an extended service life.

In embodiments that use different materials for the surface region 148 and core 146 of the toner loading roll 136, materials with different mechanical, electrical and/or chemical properties can be selected for different portions of the toner loading roll 136. In the toner loading roll, the surface region provides an outer skin having different physical properties from those of the underlying core. The electrical conductivity and the tribo-electrical interaction of the surface region 148 with the toner can be controlled by the appropriate selection of the composition of the surface region 148.

In other embodiments, the toner loading roll can comprise a core including two or more layers, and/or a surface region including two or more layers. In embodiments including a surface region having multiple layers, the outermost layer can have an outer surface with protrusions or depressions.

In embodiments of the toner loading roll 136 including a core 146 and surface region 148 of the same material, and also in embodiments including a core 146 and surface region 148 of different materials, the outer surface 156 is free of pores to prevent toner penetration of the outer surface 156 during use of the xerographic imaging module 120 to produce prints. The outer surface 156 provides a smooth, uniform, continuous toner-impermeable surface in the toner loading roll 136. Consequently, the surface region 148 maintains sufficient elasticity to allow the toner loading roll 136 to deliver toner effectively to the donor roll 128 after a large number of copies have been produced using the xerographic imaging module 120, to thereby extend the operational life of the xerographic imaging module 120. For example, in embodiments, it is desirable to be able to produce at least 10,000 copies, 50,000 copies, 100,000 copies, or even a greater number of copies, with the xerographic imaging module 120 before replacement.

The xerographic imaging module 120 can be refilled with toner after the level of toner 134 contained in the xerographic imaging module 120 becomes low. To allow this refilling, the xerographic imaging module 120 can be provided in a kit that also includes a container of extra toner. The housing 132 of the xerographic imaging module can include a refilling port through which extra toner can be supplied in the xerographic imaging module 120.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A xerographic imaging module, comprising:

a photoreceptor roll including a photoconductive surface;

a donor roll adjacent the photoreceptor roll for supplying toner to the photoconductive surface; and a toner loading roll adjacent the donor roll for supplying the toner to the donor roll, the toner loading roll comprising:

a core comprised of a foam first material; and a non-porous surface region comprised of the first material, the surface region surrounding the core and forming an outer surface of the toner loading roll, wherein the first material is an elastomer, and the surface region has a thickness of about 0.05 mm to about 0.5 mm and a Shore-A hardness of about 10 to about 45.

2. The xerographic imaging module of claim 1, wherein the outer surface of the toner loading roll is u-shaped with longitudinal grooves.

3. The xerographic imaging module of claim 1, wherein:

the toner loading roll is cylindrical-shaped and includes a longitudinal axis; and the outer surface of the toner loading roll includes circumferentially-spaced, longitudinal grooves extending parallel to the longitudinal axis.

4. The xerographic imaging module of claim 1, wherein the outer surface of the toner loading roll includes protuberances.

5. The xerographic imaging module of claim 1, further comprising:

a charging station for producing an electrical charge on the photoconductive surface of the photoreceptor roll; and an imaging station including a light source for exposing the charged photoconductive surface of the photoreceptor roll to form a latent electrostatic image on the photoreceptor roll;

wherein the toner loading roll supplies the toner to the latent electrostatic image to form a toner image on the photoconductive surface.

6. A xerographic apparatus, comprising:

an intermediate transfer belt including an outer surface;

first, second, third and fourth xerographic imaging modules according to claim 5 arranged successively along the outer surface of the intermediate transfer belt, the first, second, third and fourth xerographic imaging modules containing a single-component developer material having black, magenta, cyan and yellow toner;

a fuser station; and a paper feeding and registration system for supplying a copy sheet to the fuser station;

wherein, for the first, second, third and fourth xerographic imaging modules, the photoreceptor roll is adapted to transfer a black, magenta, cyan and yellow toner image, respectively, to the intermediate transfer belt to thereby form four built-up color separations in a full-color toner image on the intermediate transfer belt;

wherein the intermediate transfer belt is adapted to transfer the full-color toned image to the copy sheet; and wherein the fuser station is adapted to fuse the full-color toned image on the copy sheet.

7. A xerographic imaging module, comprising:

a photoreceptor roll including a photoconductive surface;

a donor roll adjacent the photoreceptor roll for supplying toner to the photoconductive surface; and a toner loading roll adjacent the donor roll for supplying the toner to the donor roll, the toner loading roll comprising:

a core comprised of a foam first material; and a non-porous surface region comprised of a second material, the surface region surrounding the core and forming an outer surface of the toner loading roll, and the second material of the surface region being adhered to the first material of the core, wherein the second material is an elastomer, and the surface region has a thickness of about 0.05 mm to about 0.5 mm and a Shore-A hardness of about 10 to about 45.

8. The xerographic imaging module of claim 7, wherein the outer surface of the toner loading roll is u-shaped with longitudinal grooves.

9. The xerographic imaging module of claim 7, wherein:

the toner loading roll includes a longitudinal axis; and the outer surface of the toner loading roll includes circumferentially-spaced, longitudinal grooves extending parallel to the longitudinal axis.

10. The xerographic imaging module of claim 7, wherein the outer surface of the toner roll includes protuberances.

11. The xerographic imaging module of claim 7, further comprising:

a charging station for producing an electrical charge on the photoconductive surface of the photoreceptor roll; and an imaging station including a light source for exposing the charged photoconductive surface of the photoreceptor roll to form a latent electrostatic image on the photoreceptor roll;

wherein the toner loading roll supplies the toner to the latent electrostatic image to form a toner image on the photoconductive surface.

12. A xerographic apparatus, comprising:

an intermediate transfer belt including an outer surface;

first, second, third and fourth xerographic imaging modules according to claim 11 arranged successively along the outer surface of the intermediate transfer belt, the first, second, third and fourth xerographic imaging modules containing a single-component developer material having black, magenta, cyan and yellow toner;

a fuser station; and a paper feeding and registration system for supplying a copy sheet to the fuser station;

wherein, for the first, second, third and fourth xerographic imaging modules, the photoreceptor roll is adapted to transfer a black, magenta, cyan and yellow toner image, respectively, to the intermediate transfer belt to thereby form four built-up color separations in a full-color toner image on the intermediate transfer belt;

wherein the intermediate transfer belt is adapted to transfer the full-color toned image to the copy sheet; and wherein the fuser station is adapted to fuse the full-color toned image on the copy sheet.

13. A method of making a xerographic imaging module for a xerographic apparatus, comprising:

making a toner loading roll by:

adding at least a first material into a first mold member;

adding at least the first material into a second mold member;

then joining the first mold member to the second mold member; and curing the at least a first material in the first mold member and the second mold member to produce the toner loading roll, the toner loading roll including (i) a core comprised of a foam material; and (ii) a non-porous surface region surrounding the core, forming an outer surface of the toner loading roll, and comprised of the first material; and mounting opposed ends of the toner loading roll, a donor roll and a photoreceptor roll to opposed walls of a housing, such that the donor roll is positioned between and adjacent the photoreceptor roll and the toner loading roll, wherein the first material is an elastomer, and the surface region has a thickness of about 0.05 mm to about 0.5 mm and a Shore-A hardness of about 10 to about 45.

14. The method of claim 13, further comprising:

prior to the joining of the first mold member to the second mold member, adding a second material into the first mold member over the first material and adding the second material into the second mold member over the first material;

wherein the core region of the toner loading roll is comprised of the second material.

15. The method of claim 13, wherein the first mold member and the second mold member each have an inner surface which is contoured to form a contoured outer surface of the toner loading roll.

16. The method of claim 15, wherein:

the toner loading roll is cylindrical shaped and includes a longitudinal axis; and the inner surface of each of the first mold member and the second mold member is contoured to form circumferentially-spaced, longitudinal grooves extending parallel to the longitudinal axis in the outer surface of the toner loading roll.

17. The method of claim 15, wherein the inner surface of each of the first mold member and the second mold member is contoured to form dimples in the outer surface of the toner loading roll.

18. The method of claim 13, further comprising placing a single-component developer material into the xerographic imaging module.

* * * * *